US008364063B2

(12) United States Patent
Ishii et al.

(10) Patent No.: US 8,364,063 B2
(45) **Date of Patent: *Jan. 29, 2013**

(54) IMAGE FORMING APPARATUS, IMAGE FORMING METHOD FOR IMAGE FORMING APPARATUS, AND PROGRAM

(75) Inventors: Shigeyuki Ishii, Kanagawa (JP); Takashi Enami, Kanagawa (JP); Nobuyuki Kobayashi, Kanagawa (JP); Jun Kosako, Kanagawa (JP); Natsuko Kawase, Kanagawa (JP); Takahiro Kamekura, Kanagawa (JP); Takahiro Miyakawa, Kanagawa (JP); Miyo Taniguchi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 303 days.

This patent is subject to a terminal disclaimer.

(21) Appl. No.: 12/787,836

(22) Filed: May 26, 2010

(65) Prior Publication Data

US 2010/0303514 A1 Dec. 2, 2010

(30) Foreign Application Priority Data

May 26, 2009 (JP) ..... 2009-126760
May 7, 2010 (JP) ..... 2010-107695

(51) Int. Cl.
*G03G 15/01* (2006.01)

(52) U.S. Cl. ..... 399/301; 399/46; 399/49; 399/66; 399/302; 399/308

(58) Field of Classification Search ..... 399/46, 399/49, 66, 301, 302, 308
See application file for complete search history.

(56) References Cited

U.S. PATENT DOCUMENTS

| | | | | |
|---|---|---|---|---|
| 5,515,145 | A * | 5/1996 | Sasaki et al. | 399/302 |
| 6,070,041 | A * | 5/2000 | Nakayasu et al. | 399/301 |
| 2004/0101332 | A1* | 5/2004 | Sohmiya et al. | 399/307 |
| 2007/0242986 | A1* | 10/2007 | Matsuyama et al. | 399/301 |
| 2008/0165377 | A1 | 7/2008 | Ishii | |
| 2010/0129103 | A1* | 5/2010 | Ogata et al. | 399/66 |
| 2010/0322679 | A1* | 12/2010 | Kobayashi et al. | 399/301 |
| 2011/0085828 | A1* | 4/2011 | Kosako et al. | 399/301 |

FOREIGN PATENT DOCUMENTS

| | | |
|---|---|---|
| JP | 2006-258847 | 9/2006 |
| JP | 2008-90092 | 4/2008 |

OTHER PUBLICATIONS

U.S. Appl. No. 12/784,921, filed May 21, 2010, Miyakawa, et al.

* cited by examiner

*Primary Examiner* — Ryan Walsh
(74) *Attorney, Agent, or Firm* — Oblon, Spivak, McClelland, Maier & Neustadt, L.L.P.

(57) ABSTRACT

There are provided an image forming apparatus, an image forming method for the image forming apparatus, and a program that can reduce misalignment among images in all colors. Rotation of at least one of a transfer-sheet conveying belt 8 and an intermediate transfer belt 6 is controlled so as to match the phases of fluctuation of the surface speed of the intermediate transfer belt 6 and fluctuation of the surface speed of the transfer-sheet conveying belt 8, whereby it is possible to keep the periodical speed fluctuations of both the intermediate transfer belt 6 and the transfer-sheet conveying belt 8 to the minimum and reduce misalignment among images in all colors.

8 Claims, 10 Drawing Sheets

FIG. 9

| | REFERENCE (EIGHTH) TO FIRST | FIRST TO SECOND | SECOND TO THIRD | THIRD TO FOURTH | FOURTH TO FIFTH | FIFTH TO SIXTH | SIXTH TO SEVENTH | SEVENTH TO REFERENCE (EIGHTH) | SUM OF DIFFERENCES |
|---|---|---|---|---|---|---|---|---|---|
| SURFACE SPEED [msec] OF INTERMEDIATE TRANSFER BELT | 300 | 310 | 320 | 310 | 300 | 290 | 280 | 290 | |
| SURFACE SPEED [msec] OF TRANSFER-SHEET CONVEYING BELT | 300 | 290 | 280 | 290 | 300 | 310 | 320 | 310 | |
| DIFFERENCE BETWEEN SURFACE SPEED OF INTERMEDIATE TRANSFER BELT AND SURFACE SPEED OF TRANSFER-SHEET CONVEYING BELT | 0 | 20 | 40 | 20 | 0 | 20 | 40 | 20 | 160 |

FIG. 10

| | REFERENCE (EIGHTH) TO FIRST | FIRST TO SECOND | SECOND TO THIRD | THIRD TO FOURTH | FOURTH TO FIFTH | FIFTH TO SIXTH | SIXTH TO SEVENTH | SEVENTH TO REFERENCE (EIGHTH) | SUM OF DIFFERENCES |
|---|---|---|---|---|---|---|---|---|---|
| SURFACE SPEED [msec] OF INTERMEDIATE TRANSFER BELT | 300 | 310 | 320 | 310 | 300 | 290 | 280 | 290 | |
| SURFACE SPEED [msec] OF TRANSFER-SHEET CONVEYING BELT | 300 | 290 | 280 | 290 | 300 | 310 | 320 | 310 | |
| SURFACE SPEED [msec] OF TRANSFER-SHEET CONVEYING BELT WITH DELAY FOR TIME ACCORDING TO PHASE DIFFERENCE CORRESPONDING TO ONE PATTERN | 290 | 280 | 290 | 300 | 310 | 320 | 310 | 300 | |
| DIFFERENCE BETWEEN SURFACE SPEED OF INTERMEDIATE TRANSFER BELT AND SURFACE SPEED OF TRANSFER-SHEET CONVEYING BELT WITH DELAY FOR TIME ACCORDING TO PHASE DIFFERENCE CORRESPONDING TO ONE PATTERN | 10 | 30 | 30 | 10 | 10 | 30 | 30 | 10 | 160 |

FIG. 11A

FIG. 11 FIG. 11A FIG. 11B

| | REFERENCE (EIGHTH) TO FIRST | FIRST TO SECOND | SECOND TO THIRD | THIRD TO FOURTH | FOURTH TO FIFTH | FIFTH TO SIXTH | SIXTH TO SEVENTH | SEVENTH TO REFERENCE (EIGHTH) | SUM OF DIFFER-ENCES |
|---|---|---|---|---|---|---|---|---|---|
| SURFACE SPEED [msec] OF INTERMEDIATE TRANSFER BELT | 300 | 310 | 320 | 310 | 300 | 290 | 280 | 290 | |
| SURFACE SPEED [msec] OF TRANSFER-SHEET CONVEYING BELT | 300 | 290 | 280 | 290 | 300 | 310 | 320 | 310 | |
| DIFFERENCE BETWEEN SURFACE SPEED OF INTERMEDIATE TRANSFER BELT AND SURFACE SPEED OF TRANSFER-SHEET CONVEYING BELT | 0 | 20 | 40 | 20 | 0 | 20 | 40 | 20 | 160 |
| DIFFERENCE BETWEEN SURFACE SPEED OF INTERMEDIATE TRANSFER BELT AND SURFACE SPEED OF TRANSFER-SHEET CONVEYING BELT WITH DELAY FOR TIME ACCORDING TO PHASE DIFFERENCE CORRESPONDING TO ONE PATTERN | 10 | 30 | 30 | 10 | 10 | 30 | 30 | 10 | 160 |
| DIFFERENCE BETWEEN SURFACE SPEED OF INTERMEDIATE TRANSFER BELT AND SURFACE SPEED OF TRANSFER-SHEET CONVEYING BELT WITH DELAY FOR TIME ACCORDING TO PHASE DIFFERENCE CORRESPONDING TO TWO PATTERNS | 20 | 20 | 20 | 0 | 20 | 20 | 20 | 0 | 120 |
| DIFFERENCE BETWEEN SURFACE SPEED OF INTERMEDIATE TRANSFER BELT AND SURFACE SPEED OF TRANSFER-SHEET CONVEYING BELT WITH DELAY FOR TIME ACCORDING TO PHASE DIFFERENCE CORRESPONDING TO THREE PATTERNS | 10 | 10 | 10 | 10 | 10 | 10 | 10 | 10 | 80 |

FIG. 11B

| | | | | | | | | | |
|---|---|---|---|---|---|---|---|---|---|
| DIFFERENCE BETWEEN SURFACE SPEED OF INTERMEDIATE TRANSFER BELT AND SURFACE SPEED OF TRANSFER-SHEET CONVEYING BELT WITH DELAY FOR TIME ACCORDING TO PHASE DIFFERENCE CORRESPONDING TO FOUR PATTERNS | 0 | 0 | 0 | 0 | 0 | 0 | 0 | 0 | 0 |
| DIFFERENCE BETWEEN SURFACE SPEED OF INTERMEDIATE TRANSFER BELT AND SURFACE SPEED OF TRANSFER-SHEET CONVEYING BELT WITH DELAY FOR TIME ACCORDING TO PHASE DIFFERENCE CORRESPONDING TO FIVE PATTERNS | 10 | 10 | 10 | 10 | 10 | 10 | 10 | 10 | 80 |
| DIFFERENCE BETWEEN SURFACE SPEED OF INTERMEDIATE TRANSFER BELT AND SURFACE SPEED OF TRANSFER-SHEET CONVEYING BELT WITH DELAY FOR TIME ACCORDING TO PHASE DIFFERENCE CORRESPONDING TO SIX PATTERNS | 20 | 0 | 20 | 20 | 20 | 0 | 20 | 20 | 120 |
| DIFFERENCE BETWEEN SURFACE SPEED OF INTERMEDIATE TRANSFER BELT AND SURFACE SPEED OF TRANSFER-SHEET CONVEYING BELT WITH DELAY FOR TIME ACCORDING TO PHASE DIFFERENCE CORRESPONDING TO SEVEN PATTERNS | 10 | 30 | 30 | 10 | 10 | 30 | 30 | 10 | 160 |

IMAGE FORMING APPARATUS, IMAGE FORMING METHOD FOR IMAGE FORMING APPARATUS, AND PROGRAM

CROSS-REFERENCE TO RELATED APPLICATIONS

The present application claims priority to and incorporates by reference the entire contents of Japanese Patent Application No. 2009-126760 filed in Japan on May 26, 2009 and Japanese Patent Application No. 2010-107695 filed in Japan on May 7, 2010.

BACKGROUND OF THE INVENTION

1. Field of the Invention

The present invention relates to an image forming apparatus, an image forming method for the image forming apparatus, and a program.

2. Description of the Related Art

Color image forming apparatuses that have an electrophotographic system use a direct transfer method for directly transferring an image formed on a photosensitive element onto a sheet and an indirect transfer method for temporarily transferring images formed on a plurality of photosensitive elements for each color onto an intermediate transfer belt so as to combine the colors and then transfer the images transferred onto the intermediate transfer belt onto a sheet. A technology is disclosed in which, as a unit that performs alignment in a color image forming apparatus that, out of the above transfer methods, transfers a black image onto a transfer sheet by the direct transfer method and transfers yellow, magenta, and cyan images formed on an intermediate transfer belt onto a transfer sheet by the indirect transfer method, a configuration is such that the time required for conveying images from a position where images formed on a plurality of photosensitive elements for each color are transferred onto an intermediate transfer belt to a position where the images transferred onto the intermediate transfer belt are transferred onto a sheet is an integral multiple of a period of a rotator that rotates the intermediate transfer belt, whereby the speed fluctuation of the intermediate transfer belt is reduced and misalignment is also reduced (see Japanese Patent Application Laid-open No. 2008-90092).

According to the technology disclosed in Japanese Patent Application Laid-open No. 2008-90092, the occurrence of misalignment due to speed fluctuation of the intermediate transfer belt can be prevented; however, consideration is only given to the speed fluctuation of the intermediate transfer belt, not to the speed fluctuation of a transfer-sheet conveying belt that conveys the transfer sheet to a position where an image transferred onto the intermediate transfer belt is transferred onto the transfer sheet, and therefore the problem of the occurrence of misalignment occurs.

SUMMARY OF THE INVENTION

It is an object of the present invention to at least partially solve the problems in the conventional technology.

According to a first aspect of the present invention, there is provided an image forming apparatus. The image forming apparatus including a transfer-sheet conveying unit that is rotated to convey a transfer sheet, a first image forming unit that directly transfers a single-color image onto the transfer sheet that is in a process of being conveyed, an intermediate transfer unit that is rotated while an image to be transferred onto the transfer sheet that is in the process of being conveyed is transferred thereon, the intermediate transfer unit having an identical length in a circumferential direction to a length of the transfer-sheet conveying unit in a circumferential direction, a second image forming unit that transfers, onto the intermediate transfer unit, an image in a plurality of colors except for a color of the image directly transferred by the first image forming unit, a secondary transfer unit that transfers the image transferred onto the intermediate transfer unit onto the transfer sheet that is in the process of being conveyed, a measuring unit that measures surface speeds of the transfer-sheet conveying unit and the intermediate transfer unit for a predetermined number of cycles, and a control unit that controls rotation of at least one of the transfer-sheet conveying unit and the intermediate transfer unit so as to match phases of fluctuation of the measured surface speed of the transfer-sheet conveying unit and fluctuation of the measured surface speed of the intermediate transfer unit.

According to a second aspect of the present invention, there is provided an image forming method for an image forming apparatus that includes a transfer-sheet conveying unit that is rotated to convey a transfer sheet, a first image forming unit that directly transfers a single-color image onto the transfer sheet that is in a process of being conveyed, an intermediate transfer unit that is rotated while an image to be transferred onto the transfer sheet that is in the process of being conveyed is transferred thereon, the intermediate transfer unit having an identical length in a circumferential direction to a length of the transfer-sheet conveying unit in a circumferential direction, a second image forming unit that transfers, onto the intermediate transfer unit, an image in a plurality of colors except for a color of the image directly transferred by the first image forming unit, and a secondary transfer unit that transfers the image transferred onto the intermediate transfer unit onto the transfer sheet that is in the process of being conveyed. The image forming method including measuring, by a measuring unit, surface speeds of the transfer-sheet conveying unit and the intermediate transfer unit for a predetermined number of cycles, and controlling, by a control unit, rotation of at least one of the transfer-sheet conveying unit and the intermediate transfer unit so as to match phases of fluctuation of the measured surface speed of the transfer-sheet conveying unit and fluctuation of the measured surface speed of the intermediate transfer unit.

According to a third aspect of the present invention, there is provided a computer program product comprising a computer usable medium having computer readable program codes embodied in the medium that when executed causes a computer to execute an image forming method for an image forming apparatus that includes a transfer-sheet conveying unit that is rotated to convey a transfer sheet, a first image forming unit that directly transfers a single-color image onto the transfer sheet that is in a process of being conveyed, an intermediate transfer unit that is rotated while an image to be transferred onto the transfer sheet that is in the process of being conveyed is transferred thereon, the intermediate transfer unit having an identical length in a circumferential direction to a length of the transfer-sheet conveying unit in a circumferential direction, a second image forming unit that transfers, onto the intermediate transfer unit, an image in a plurality of colors except for a color of the image directly transferred by the first image forming unit, and a secondary transfer unit that transfers the image transferred onto the intermediate transfer unit onto the transfer sheet that is in the process of being conveyed. The image forming method including measuring, by a measuring unit, surface speeds of the transfer-sheet conveying unit and the intermediate transfer unit for a predetermined number of cycles, and controlling, by a control unit, rotation of at least one of the transfer-sheet conveying unit and the intermediate transfer unit so as to match phases of fluctuation of the measured surface speed of the transfer-sheet conveying unit and fluctuation of the measured surface speed of the intermediate transfer unit.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 9 is a table that illustrates measurement results of the surface speeds of the intermediate transfer belt and the transfer-sheet conveying belt and the difference between the surface speeds of the belts;

FIG. 10 is a table that illustrates measurement results of the surface speeds of the intermediate transfer belt and the transfer-sheet conveying belt and also illustrates the surface speed of the transfer-sheet conveying belt and the difference between the surface speeds of the belts when the rotation of the transfer-sheet conveying belt is delayed for the time according to the phase difference corresponding to one pattern; and FIG. 11 is a table that illustrates measurement results of the surface speeds of the intermediate transfer belt and the transfer-sheet conveying belt and also illustrates the surface speed of the transfer-sheet conveying belt and the difference between the surface speeds of the belts when the rotation of the transfer-sheet conveying belt is delayed for the times according to the phase differences corresponding to one to seven patterns.

DETAILED DESCRIPTION OF THE PREFERRED EMBODIMENTS

Preferred embodiments of an image forming apparatus, an image forming method for the image forming apparatus, and a program according to the present invention are explained in detail below with reference to the accompanying drawings.

An explanation is given of an embodiment of the present invention with reference to FIGS. 1 to 11. In an example according to the present embodiment, what is called a Multi Function Peripheral (MFP), a color digital MFP, that has, in combination, a copy function, a facsimile (FAX) function, a print function, a scanner function, a function for distributing an input image (an image of an original read using a scanner function or an image input using a printer or FAX function), and the like is used as a color image forming apparatus.

Figure 1:
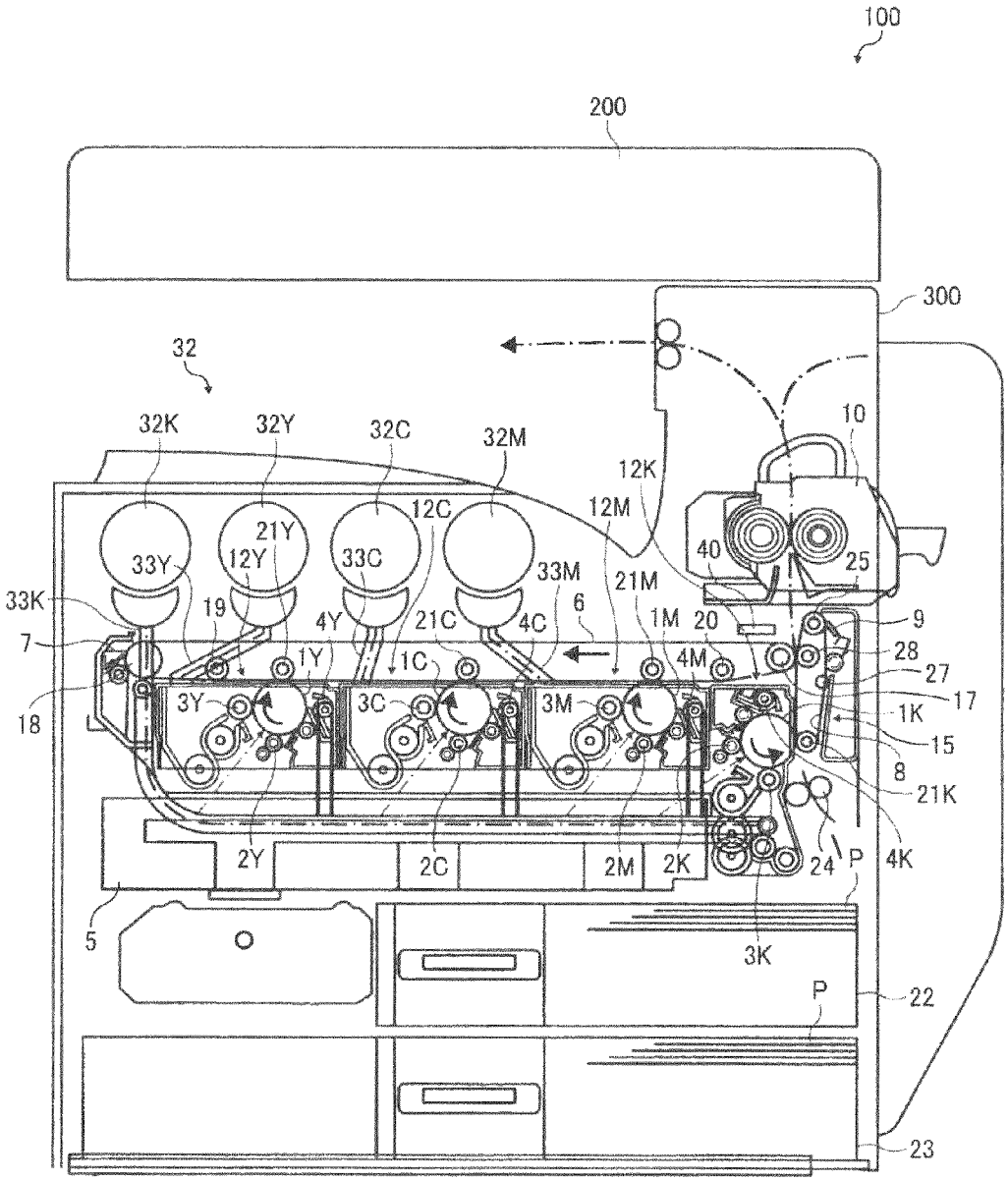
FIG. 1 is a schematic diagram of a color digital MFP according to an embodiment of the present invention.

FIG. 1 is a schematic diagram of a color digital MFP according to an embodiment of the present invention. As illustrated in FIG. 1, a color digital MFP 100 is made up of a scanner unit 200 that is an image read apparatus and a printer unit 300 that is an image print apparatus. An engine control unit 500 (see FIG. 3) is made up of the scanner unit 200 and the printer unit 300. In the color digital MFP 100 according to the present embodiment, a document box function, a copy function, a printer function, and a facsimile function can be sequentially selected by using an application switch key of an operating unit 400 (see FIG. 3). The document box mode is set when the document box function is selected, the copy mode is set when the copy function is selected, the printer mode is set when the printer function is selected, and the facsimile mode is set when the facsimile function is selected.

A detailed explanation is given of the printer unit 300 that has the characteristic functions of the color digital MFP 100 according to the present embodiment. In the printer unit 300 of the color digital MFP 100, an image forming unit (a first image forming unit) 12K for black (K) is separately arranged. The image forming unit 12K for black (K) is arranged such that a black toner image (a single-color image) is formed and the formed black toner image is directly transferred onto a transfer sheet P that is in the process of being conveyed. More specifically, the image forming unit 12K for black is separate from the transfer structures for colors Y, C, and M that are opposed to an intermediate transfer belt 6, which is explained later, and the toner image for black (K) formed thereby is directly transferred onto the transfer sheet P by a secondary transfer unit 15 rather than the intermediate transfer belt 6.

The intermediate transfer belt 6 (an intermediate transfer unit) extends substantially horizontally in a loop and rotates in the extending direction of the intermediate transfer belt 6 while a toner image, which is to be transferred to the transfer sheet P, is transferred thereon. In the present embodiment, the intermediate transfer belt 6 is supported by a drive roller 17, a follower roller 18, and tension rollers 19 and 20. A cleaning unit 7 that removes residual toner from the intermediate transfer belt 6 is located on the outer side of the intermediate transfer belt 6 and is opposed to the follower roller 18. A marker 50*a* (see FIG. 6) that functions as an indicator of the base point of rotation of the intermediate transfer belt 6 is present on the intermediate transfer belt 6.

In addition, as illustrated in FIG. 1, the printer unit 300 in the color digital MFP 100 has a tandem system in which three image forming units (a second image forming unit) 12Y, 12C, and 12M are serially arranged in the belt-moving direction along the intermediate transfer belt 6, whereby toner images for yellow, cyan, and magenta (hereinafter, abbreviated as Y, C, M) (images in a plurality of colors except for the color of the image directly transferred by the image forming unit 12K) are formed and the formed toner images for colors Y, C, and M are transferred onto the intermediate transfer belt 6.

As illustrated in FIG. 1, the printer unit 300 in the color digital MFP 100 further includes the secondary transfer unit 15 that is arranged such that it substantially vertically intersects with the intermediate transfer belt 6 extending substantially horizontally and is located at a position on the conveying path of the transfer sheet P, i.e., a position where a plurality of color images transferred (superimposed) on the intermediate transfer belt 6 is transferred onto the transfer sheet P, on which a black toner image has been directly transferred. According to the present embodiment, the image forming unit 12K for black is located near and along the substantially vertical conveying path of the transfer sheet P, and the secondary transfer unit 15 is located in a space on the upstream side of a fixing device 10 on the substantially vertical conveying path.

Figure 2:
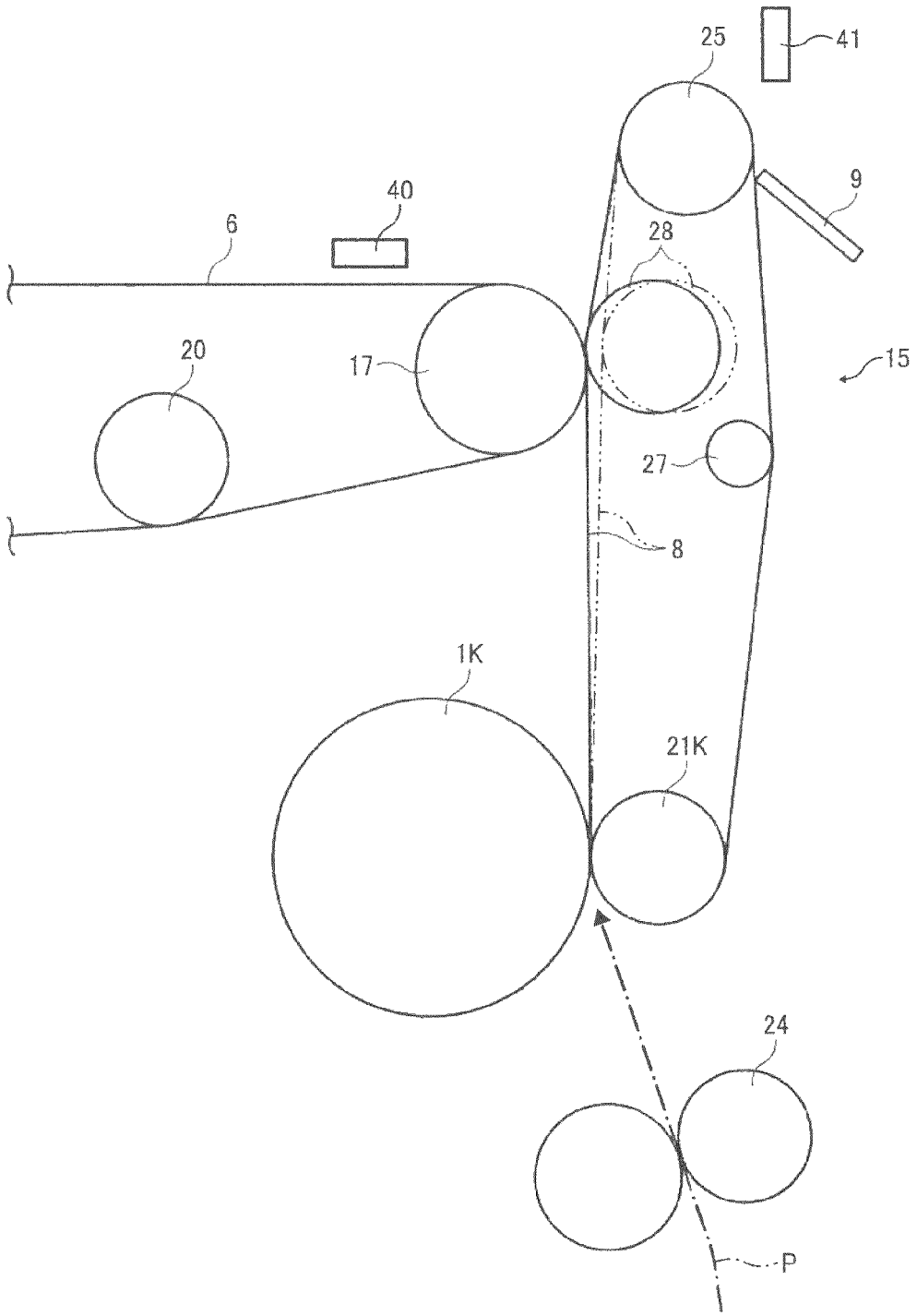
FIG. 2 is a schematic diagram that schematically illustrates the configuration of a secondary transfer unit.

FIG. 2 is a schematic diagram that schematically illustrates the configuration of the secondary transfer unit. As illustrated in FIG. 2, the secondary transfer unit 15 includes a transfer-sheet conveying belt 8 that rotates in its extending direction so as to convey the transfer sheet P, a drive roller 25 that supports the transfer-sheet conveying belt 8, a follower roller 21K that is also a transfer unit, a tension roller 27, a secondary transfer roller 28 that is a secondary transfer unit, a cleaning unit 9 that cleans the transfer-sheet conveying belt 8, and the like. The secondary transfer roller 28 is arranged such that it is opposed to the drive roller 17 of the intermediate transfer belt 6 and can be located close to or located away from the intermediate transfer belt 6 by an undepicted contact/separate mechanism. The secondary transfer roller 28 is located close to the intermediate transfer belt 6 so that toner images for colors Y, M, and C, which have been transferred onto the intermediate transfer belt 6, are transferred onto the transfer sheet P conveyed by the transfer-sheet conveying belt 8. In the same manner as for the intermediate transfer belt 6, the marker 50*a* (see FIG. 6) that functions as an indicator of the base point of rotation of the transfer-sheet conveying belt 8 is present on the transfer-sheet conveying belt 8. The circumferential length (the length in the circumferential direction) of the transfer-sheet conveying belt 8 is identical to the circumferential length (the length in the circumferential direction) of the intermediate transfer belt 6.

Although the secondary transfer unit 15 according to the present embodiment has a configuration to displace the secondary transfer roller 28, the present invention is not limited thereto and the entire transfer-sheet conveying belt 8 may be displaced by using the follower roller 21K as a supporting point.

A conventional configuration is known that locates an intermediate transfer belt away from image carriers for colors except black during formation of monochrome images. In this system, only the intermediate transfer belt is driven and image forming units for colors except black do not need to be driven (run idle); however, because the intermediate transfer belt is displaced, the problem of tension variation is inevitable. If a configuration is such that the secondary transfer roller is displaced or the entire transfer-sheet conveying belt is displaced, the transfer-sheet conveying belt, which generally has a circumferential length much shorter than that of the intermediate transfer belt, is moved in or away so that the intermediate transfer belt can be left unchanged (does not move together with the transfer-sheet conveying belt); therefore, the tension of the intermediate transfer belt does not vary. Specifically, a configuration can be such that the intermediate transfer belt, for which alignment needs to be performed at many points, is brought into contact with or separated from the transfer-sheet conveying belt; however, in this case, there is a possibility that the position accuracy for alignment is decreased over time. Conversely, according to the present embodiment, because a configuration can be such that the intermediate transfer belt 6 is kept in contact with the respective photosensitive elements (1Y, 1C, 1M) for colors Y, C, and M, high positioning accuracy can be set between rollers with respect to the intermediate transfer belt 6, which improves the allowance for shifting of the belt. Furthermore, because the belt is moved in a stable manner, it is possible to improve the allowance for misalignment (color deviation) during formation of full-color images.

A configuration may be such that the drive roller 17, which supports the intermediate transfer belt 6, is displaced by an undepicted unit so that the intermediate transfer belt 6 is brought into contact with or separated from the transfer-sheet conveying belt 8. In this case, because the conveying position of the transfer sheet P does not change, the behavior of the transfer sheet P is not unstable between the transfer-sheet conveying belt 8 and the fixing device 10. Therefore, it is possible to prevent the occurrence of folds in or image distortion of the transfer sheet P discharged from the fixing device 10. Furthermore, a configuration may be such that both the secondary transfer roller 28 in the secondary transfer unit 15 and the drive roller 17, which supports the intermediate transfer belt 6, are moved so that the intermediate transfer belt 6 and the transfer-sheet conveying belt 8 are brought into contact with or separated from each other.

Refer back to FIG. 1. Each of the image forming units 12Y, 12C, 12M, and 12K is configured as a process cartridge that is removable from the main body of the printer unit 300. The image forming unit 12 (12Y, 12C, 12M, 12K) includes the photosensitive element 1 (1Y, 1C, 1M, 1K) that is an image carrier, a charging device 2 (2Y, 2C, 2M, 2K), a developing device 3 (3Y, 3C, 3M, 3K) that feeds toner to a latent image to form a toner image, a cleaning device 4 (4Y, 4C, 4M, 4K), and the like. In the image forming units 12Y, 12C, and 12M, the photosensitive elements 1Y, 1C, and 1M are arranged such that they are in contact with the stretched surface of the lower side of the intermediate transfer belt 6. Primary transfer rollers 21Y, 21C, and 21M are arranged as primary transfer units on the inner side of the intermediate transfer belt 6 such that they are opposed to the photosensitive elements 1 (1Y, 1C, 1M).

The printer unit 300 in the color digital MFP 100 includes an exposure device 5 that emits laser light from an undepicted LD and corresponds to the image forming unit 12 (12Y, 12C, 12M, 12K) for respective colors. An original read by the scanner unit 200, data received by a facsimile, or the like, or color image information transmitted from a computer is subjected to color separation for each of the colors of yellow, cyan, magenta, and black so as to form data for each color, and the data is then sent to the exposure device 5 in the image forming unit 12 (12Y, 12C, 12M, 12K) for respective colors. The laser light emitted from the LD of the exposure device 5 forms an electrostatic latent image on the photosensitive element 1 (1Y, 1C, 1M, 1K) of the image forming unit 12 (12Y, 12C, 12M, 12K).

Although the blade-type cleaning device 4 is used according to the present embodiment, the present invention is not limited thereto, and a fur-brush roller or a magnetic-brush cleaning system may be used. The exposure device 5 is not limited to a laser system and may be a Light Emitting Diode (LED) system, or the like.

As illustrated in FIGS. 1 and 2, the printer unit 300 in the color digital MFP 100 includes pattern detection sensors 40 and 41 that are located in the middle of the intermediate transfer belt 6 in a width direction and detect a belt surface-speed measurement pattern 50 and the marker 50*a* (see FIG. 6), which are used to measure a subtle fluctuation, or the like, in the surface speed of the intermediate transfer belt 6 and the surface speed of the transfer-sheet conveying belt 8.

For example, if reflective optical sensors (regular-reflection optical sensors) are used as the pattern detection sensors 40 and 41, the intermediate transfer belt 6 and the transfer-sheet conveying belt 8 are irradiated with light so that the pattern detection sensors 40 and 41 detect light reflected by the belt surface-speed measurement pattern 50 and the marker 50*a* (see FIG. 6) that are formed on the intermediate transfer belt 6 and the transfer-sheet conveying belt 8, whereby information used for measuring the surface speeds of the intermediate transfer belt 6 and the transfer-sheet conveying belt 8 is obtained.

Figure 6:
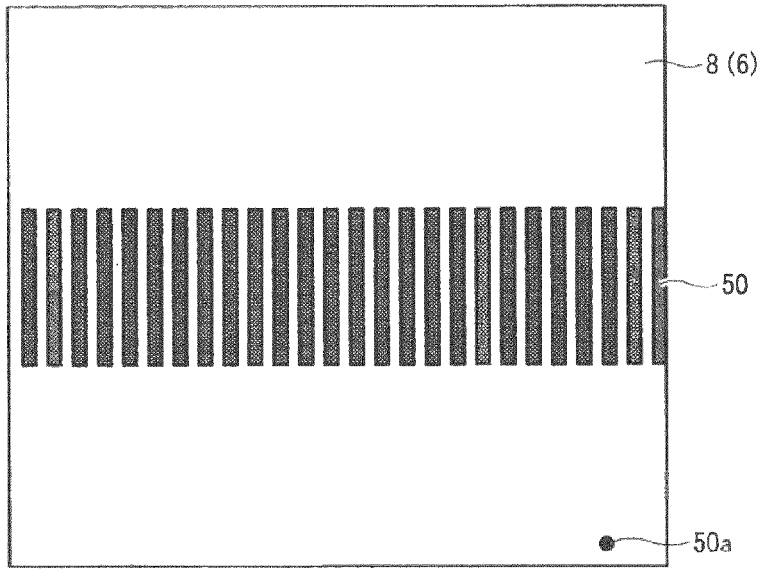
FIG. 6 is a plan view that illustrates an example of a belt surface-speed measurement pattern.

Although the regular-reflection optical sensors are used as the pattern detection sensors 40 and 41 according to the present embodiment, the present invention is not limited thereto and a diffusion optical sensor unit may be used that reads light diffused by the belt surface-speed measurement pattern 50 and the marker 50*a* (see FIG. 6).

Feed trays 22 and 23 that contain transfer sheets of different sizes are located under the printer unit 300 of the color digital MFP 100, and the transfer sheet P fed from each of the feed trays 22 and 23 by an undepicted feed unit is conveyed to a registration roller pair 24 by an undepicted conveying unit so that skew is corrected by the registration roller pair 24 and then the transfer sheet P is conveyed by the registration roller pair 24 to a transfer area between the photosensitive element 1K and the transfer-sheet conveying belt 8 at a predetermined time.

The printer unit 300 in the color digital MFP 100 further includes a toner bank 32 that is located above the intermediate transfer belt 6. The toner bank 32 is made up of toner tanks 32K, 32Y, 32C, and 32M, and these toner tanks are coupled to the developing devices 3 (3Y, 3C, 3M, 3K) via toner feed pipes 33K, 33Y, 33C, and 33M. Because the image forming unit 12K for black is arranged separately from the image forming units 12 (12Y, 12C, 12M) for colors Y, C, and M, transfer toner for colors Y, C, and M does not get mixed during the process of forming black images. Therefore, toner collected from the photosensitive element 1K is conveyed to the developing device 3K for black via an undepicted black-toner collection path and is then reused. A device that removes paper dust or a device that can switch a path to dispose of toner may be located along the black-toner collection path.

Figure 3:
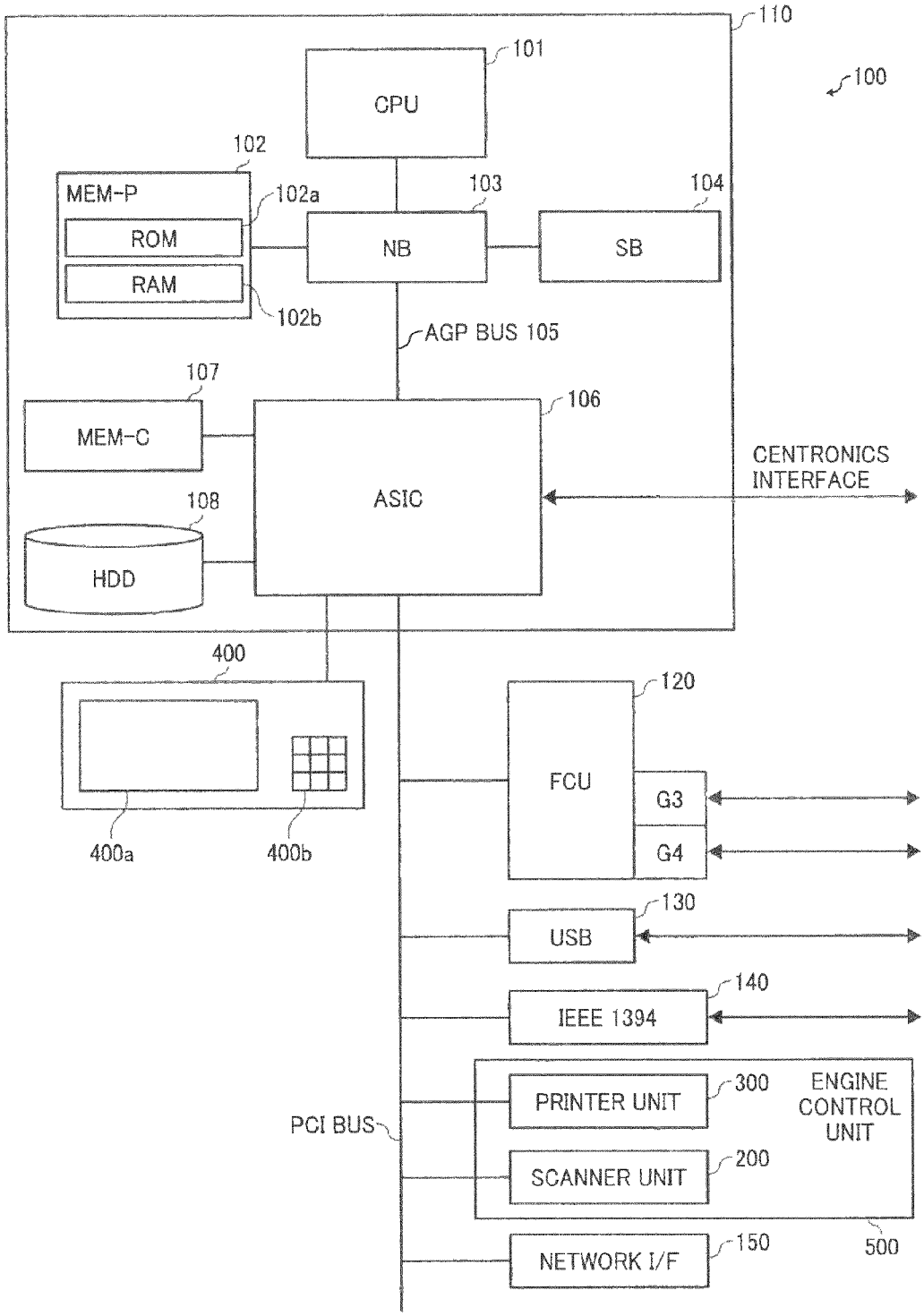
FIG. 3 is a block diagram that illustrates the hardware configuration of the color digital MFP.

Next, an explanation is given of the hardware configuration of the color digital MFP 100. FIG. 3 is a block diagram that illustrates the hardware configuration of the color digital MFP. As illustrated in FIG. 3, the color digital MFP 100 has a configuration such that a controller 110, the printer unit 300, and the scanner unit 200 are coupled to one another via a Peripheral Component Interconnect (PCI) bus. The controller 110 is a controller that controls the entire color digital MFP 100 and controls drawings, communication, and input from the operating unit 400. The printer unit 300 or the scanner unit 200 includes an image processing section for error diffusion, gamma transformation, or the like. The operating unit 400 includes an operation displaying unit 400*a* that displays, on a Liquid Crystal Display (LCD), original image information, or the like, on an original read by the scanner unit 200 and receives input from the operator via a touch panel and also includes a keyboard unit 400*b* that receives input keyed in by the operator.

In the color digital MFP 100 according to the present embodiment, a document box function, a copy function, a printer function, and a facsimile function can be sequentially selected by using an application switch key of the operating unit 400. The document box mode is set when the document box function is selected, the copy mode is set when the copy function is selected, the printer mode is set when the printer function is selected, and the facsimile mode is set when the facsimile function is selected.

The controller 110 includes a Central Processing Unit (CPU) 101 that is the main part of a computer, a system memory (MEM-P) 102, a north bridge (NB) 103, a south bridge (SB) 104, an Application Specific Integrated Circuit (ASIC) 106, a local memory (MEM-C) 107 that is a storage unit, and a hard disk drive (HDD) 108 that is a storage unit and has a configuration such that the NB 103 is coupled to the ASIC 106 via an Accelerated Graphics Port (AGP) bus 105. The MEM-P 102 further includes a Read Only Memory (ROM) 102*a* and a Random Access Memory (RAM) 102*b*.

The CPU 101 performs overall control of the color digital MFP 100 and includes a chip set made up of the NB 103, the MEM-P 102, and the SB 104 so that the CPU 101 is coupled to other devices via the chip set.

The NB 103 is a bridge to connect the CPU 101, the MEM-P 102, the SB 104, and the AGP bus 105 and includes a memory controller that controls reading from and writing to the MEM-P 102, a PCI master, and an AGP target.

The MEM-P 102 is a system memory used as a memory for storing programs and data, a memory for loading programs and data, a memory for drawing by a printer, or the like, and includes the ROM 102*a* and the RAM 102*b*. The ROM 102*a* is a read-only memory used as a memory for storing programs for controlling operations of the CPU 101 and data, and the RAM 102*b* is a writable and readable memory used as a memory for loading programs and data, a memory for drawing by a printer, or the like.

The SB 104 is a bridge to connect the NB 103, a PCI device, and a peripheral device. The SB 104 is connected to the NB 103 via the PCI bus, and a network interface (I/F) unit 150, or the like, is also connected to the PCI bus.

The ASIC 106 is an Integrated Circuit (IC) intended for image processing that includes a hardware element for image processing, and has a function as a bridge to connect the AGP bus 105, the PCI bus, the HDD 108, and the MEM-C 107. The ASIC 106 is made up of a PCI target, an AGP master, an arbiter (ARB) that is the central core of the ASIC 106, a memory controller that controls the MEM-C 107, a plurality of Direct Memory Access Controllers (DMACs) that performs the rotation of image data, or the like, by using hardware logic, and a PCI unit that performs data transfer with the printer unit 300 or the scanner unit 200 via the PCI bus. A Fax Control Unit (FCU) 120, a Universal Serial Bus (USB) 130, an IEEE 1394 (the Institute of Electrical and Electronics Engineers 1394) interface 140 are connected to the ASIC 106 via the PCI bus.

The MEM-C 107 is a local memory used as a copy image buffer or a code buffer, and the HDD 108 is storage for storing image data, storing programs for controlling operations of the CPU 101, storing font data, and storing forms.

The AGP bus 105 is a bus interface for a graphics accelerator card proposed for speeding up graphics processes and directly accesses the MEM-P 102 at a high throughput so that the speed of the graphics accelerator card is increased.

A program to be executed by the color digital MFP 100 according to the present embodiment is provided by being installed on a ROM, or the like, in advance. A configuration may be such that a program to be executed by the color digital MFP 100 according to the present embodiment is provided by being stored, in the form of a file that is installable and executable, in a recording medium readable by a computer, such as a CD-ROM, a flexible disk (FD), a CD-R, or a Digital Versatile Disk (DVD).

Furthermore, a configuration may be such that a program to be executed by the color digital MFP 100 according to the present embodiment is stored in a computer connected via a network such as the Internet and provided by being downloaded via the network. Moreover, a configuration may be such that a program to be executed by the color digital MFP 100 according to the present embodiment is provided or distributed via a network such as the Internet.

Figure 4:
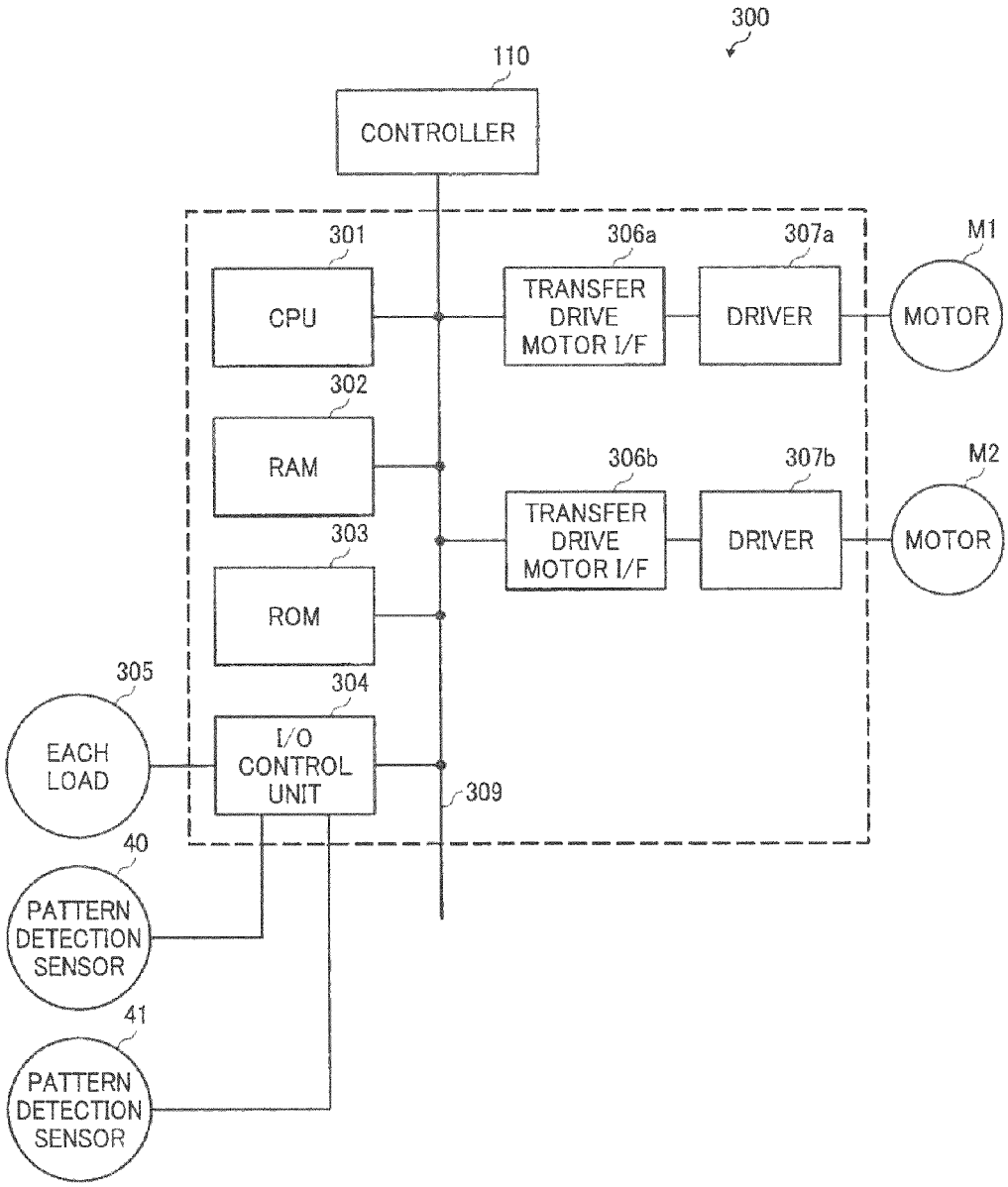
FIG. 4 is a block diagram that illustrates the hardware configuration of a printer unit.

FIG. 4 is a block diagram that illustrates the hardware configuration of the printer unit. As illustrated in FIG. 4, the control system of the printer unit 300 is made up of a CPU 301, a RAM 302, a ROM 303, an I/O control unit 304, a transfer drive motor I/F unit 306*a*, a driver 307*a*, a transfer drive motor I/F unit 306*b*, and a driver 307*b*.

The CPU 301 performs overall control of the printer unit 300, including the control of reception of image data input from the controller 110 and transmission and reception of control commands.

The RAM 302 used for working, the ROM 303 for storing programs, and the I/O control unit 304 are connected to one another via a bus 309, and data read/write processes and various operations of a motor, clutch, solenoid, sensor, or the like, for driving each load 305 such as a contact/separate mechanism are executed in response to an instruction from the CPU 301. Further, in response to an instruction from the CPU 301, the RAM 302 used for working, the ROM 303 for storing programs, and the I/O control unit 304 perform an operation of acquiring detection results of the belt surface-speed measurement pattern 50 and the marker 50*a* (see FIG. 6) obtained by the pattern detection sensors 40 and 41.

In response to a drive command from the CPU 301, the transfer drive motor I/F 306*a* outputs a command signal to the driver 307*a* so as to command the drive frequency of a drive pulse signal. A transfer drive motor M1 is rotated in accordance with the frequency. The drive roller 17 illustrated in FIG. 2 is rotated in accordance with the rotation of the transfer drive motor M1. Similarly, in response to a drive command from the CPU 301, the transfer drive motor I/F 306*b* outputs a command signal to the driver 307*b* so as to command the drive frequency of a drive pulse signal. A transfer drive motor M2 is rotated in accordance with the frequency. The drive roller 25 illustrated in FIG. 2 is rotated in accordance with the rotation of the transfer drive motor M2.

The RAM 302 is used as a work area for executing programs stored in the ROM 303. Because the RAM 302 is a volatile memory, parameters, such as amplitude or phase value, to be used for a subsequent belt drive are stored in an undepicted nonvolatile memory such as an Electrically Erasable Programmable Read Only Memory (EEPROM), and data corresponding to one cycle of a belt is loaded into the RAM 302 using a sine function or an approximate equation when the power is turned on or the drive roller 17 is driven.

A program executed by the printer unit 300 according to the present embodiment has a module configuration including each of the units described later (a print control unit 51, an alignment control unit 52, an indirect transfer control unit 53, a direct transfer control unit 54, a secondary transfer control unit 55 (see FIG. 5), and the like), and, as actual hardware, the CPU 301 reads a program from the ROM 303 and executes the read program so as to load each of the units described above into a main storage so that the print control unit 51, the alignment control unit 52, the indirect transfer control unit 53, the direct transfer control unit 54, the secondary transfer control unit 55, and the like are generated in the main storage.

Figure 5:
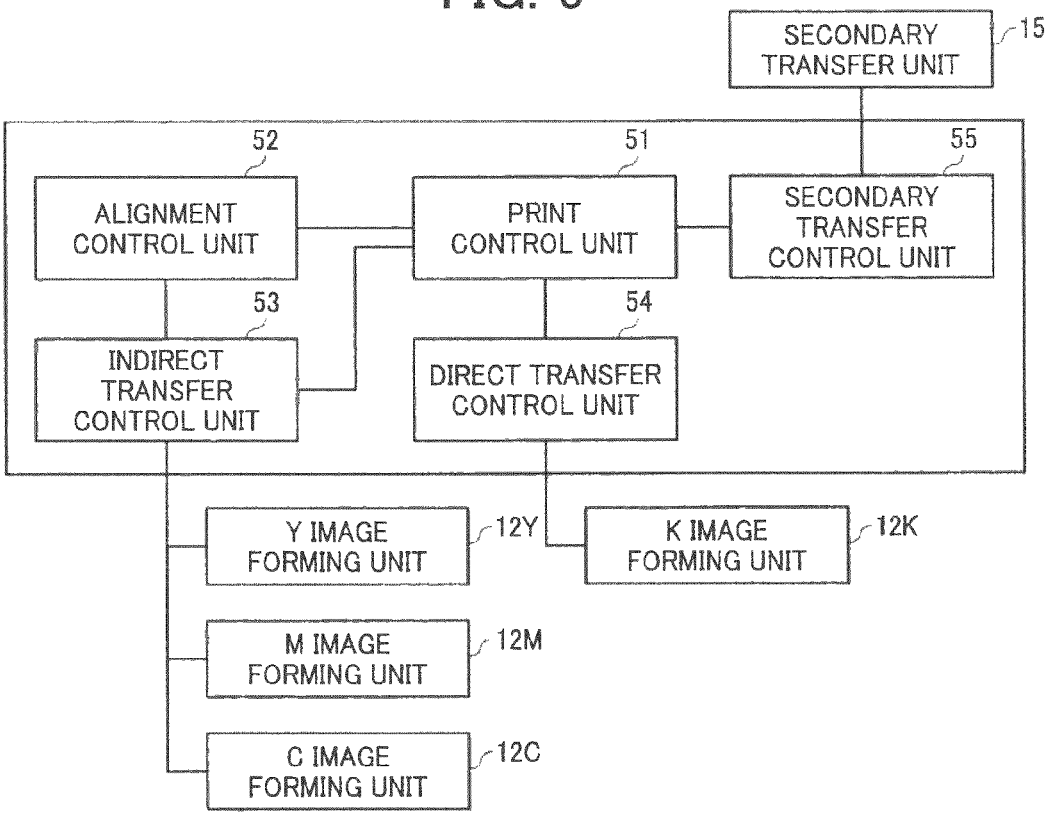
FIG. 5 is a block diagram that illustrates the functional configuration of the printer unit.

FIG. 5 is a block diagram that illustrates the functional configuration of the printer unit 300. The functional block illustrated in FIG. 5 illustrates functions or units implemented by executing programs according to the present embodiment. The CPU 301 is operated in accordance with programs so that the printer unit 300 includes the print control unit 51, the alignment control unit 52, the indirect transfer control unit 53, the direct transfer control unit 54, and the secondary transfer control unit 55.

The print control unit 51 controls the entire system (the alignment control unit 52, the indirect transfer control unit 53, the direct transfer control unit 54, the secondary transfer control unit 55, and the like) in order to perform full-color printing and black-and-white printing.

The direct transfer control unit 54 controls the image forming unit 12K for color K during full-color printing and black-and-white printing so as to form a black toner image to be directly transferred onto the transfer sheet P. More specifically, the control of the direct transfer control unit 54 causes the photosensitive element 1K of the image forming unit 12K for color K to form a toner image.

In addition, the direct transfer control unit 54 controls the image forming unit 12K for color K so as to form an image of the belt surface-speed measurement pattern 50 (see FIG. 6) to be used for alignment control by the alignment control unit 52 and so as to transfer the formed belt surface-speed measurement pattern 50 onto the transfer-sheet conveying belt 8.

The indirect transfer control unit 53 controls the image forming units 12 (12Y, 12C, 12M) for colors Y, M, and C and controls the intermediate transfer belt 6 during full-color printing so as to form an image to be transferred onto the transfer sheet P. More specifically, the control of the indirect transfer control unit 53 causes toner images for colors Y, M, and C formed by the photosensitive elements 1 (1Y, 1C, 1M) of the image forming units 12 (12Y, 12C, 12M) to be superimposed on the intermediate transfer belt 6 by an indirect transfer method.

In addition, the indirect transfer control unit 53 controls any one of the image forming units 12Y, 12C and 12M for colors Y, M, and C and controls the intermediate transfer belt 6 so as to form an image of the belt surface-speed measurement pattern 50 (see FIG. 6) to be used for alignment control by the alignment control unit 52 and so as to transfer the formed belt surface-speed measurement pattern 50 onto the intermediate transfer belt 6.

The secondary transfer control unit 55 controls the secondary transfer roller 28 of the secondary transfer unit 15 so as to locate the secondary transfer roller 28 close to or away from the intermediate transfer belt 6. More specifically, during full-color printing, the secondary transfer control unit 55 locates the secondary transfer roller 28 close to the intermediate transfer belt 6 at a position where images can be transferred onto the transfer sheet P. Thus, toner images for colors Y, M, and C, which have been superimposed on the intermediate transfer belt 6 by the indirect transfer method, are transferred onto the transfer sheet P at the position of the secondary transfer roller 28 of the secondary transfer unit 15. During black-and-white printing, the secondary transfer control unit 55 locates the secondary transfer roller 28 away from the intermediate transfer belt 6 because there is no need to transfer toner images for colors Y, M, and C onto the transfer sheet P. Thus, a formed black toner image is transferred onto the transfer sheet P at the position of the secondary transfer roller 28 of the secondary transfer unit 15 by a direct transfer method. During formation of an image of the belt surface-speed measurement pattern 50 used for alignment control, the secondary transfer control unit 55 controls the secondary transfer roller 28 of the secondary transfer unit 15 so as to locate the secondary transfer roller 28 away from the intermediate transfer belt 6 because there is no need to transfer toner images for colors Y, M, and C onto the transfer sheet P.

The alignment control unit (a measuring unit) 52 measures the surface speeds of the intermediate transfer belt 6 and the transfer-sheet conveying belt 8 for a predetermined number of cycles (for example, one cycle) using the detection results of the belt surface-speed measurement pattern 50 and the marker 50*a* (see FIG. 6) acquired by the I/O control unit 304. The alignment control unit (a control unit) 52 controls the rotation of at least one of the transfer-sheet conveying belt 8 and the intermediate transfer belt 6 so as to match the phases of the fluctuation of the measured surface speed of the intermediate transfer belt 6 and the fluctuation of the measured surface speed of the transfer-sheet conveying belt 8, thereby performing alignment control.

For the alignment control, the belt surface-speed measurement pattern 50 illustrated in FIG. 6 is formed on the intermediate transfer belt 6 and the transfer-sheet conveying belt 8 in order to determine the fluctuation of the surface speed of each of the intermediate transfer belt 6 and the transfer-sheet conveying belt 8. FIG. 6 is a plan view that illustrates an example of the belt surface-speed measurement pattern. As illustrated in FIG. 6, the belt surface-speed measurement pattern 50 is obtained by arranging straight-line patterns at equal intervals in the sub-scanning direction in the middle of each of the intermediate transfer belt 6 and the transfer-sheet conveying belt 8 in a width direction. The belt surface-speed measurement pattern 50 is formed along the moving direction of each of the intermediate transfer belt 6 and the transfer-sheet conveying belt 8 until each of the intermediate transfer belt 6 and the transfer-sheet conveying belt 8 has moved for one cycle. For example, the indirect transfer control unit 53 controls the image forming unit 12Y for color Y and the intermediate transfer belt 6 so as to form a toner image of the belt surface-speed measurement pattern 50 on the photosensitive element 1Y at a certain interval and transfer the formed toner image of the belt surface-speed measurement pattern 50 onto the intermediate transfer belt 6 by using the primary transfer roller 21Y. The direct transfer control unit 54 controls the image forming unit 12K for color K so as to form a toner image of the belt surface-speed measurement pattern 50 on the photosensitive element 1K at a certain interval and transfer the formed toner image of the belt surface-speed measurement pattern 50 onto the transfer-sheet conveying belt 8 by using the follower roller 21K.

If the belt surface-speed measurement pattern 50 is transferred onto each of the intermediate transfer belt 6 and the transfer-sheet conveying belt 8, the alignment control unit 52 instructs the I/O control unit 304 to detect the marker 50*a* by using the pattern detection sensors 40 and 41. Then, the alignment control unit 52 can determine the time when the marker 50*a* passes through the pattern detection sensors 40 and 41 (or that the intermediate transfer belt 6 and the transfer-sheet conveying belt 8 are moved for one cycle) using sensor signals that are output from the pattern detection sensors 40 and 41 to the I/O control unit 304 and indicates detection of the marker 50*a*.

Upon determining that the marker 50*a* has passed through the pattern detection sensors 40 and 41, the alignment control unit 52 instructs the I/O control unit 304 to start detecting the belt surface-speed measurement pattern 50 using the pattern detection sensors 40 and 41. The alignment control unit 52 then measures the moving times of the intermediate transfer belt 6 and the transfer-sheet conveying belt 8, which are taken from when the pattern detection sensors 40 and 41 output sensor signals, which indicate detection of one straight-line pattern, to the I/O control unit 304 to when the pattern detection sensors 40 and 41 output sensor signals, which indicate detection of a subsequent straight-line pattern, to the I/O control unit 304. The alignment control unit 52 sequentially measures the moving time until determining that the marker 50*a* has passed through the pattern detection sensors 40 and 41 again (i.e., until the intermediate transfer belt 6 and the transfer-sheet conveying belt 8 have moved for one cycle) so as to determine fluctuation of the surface speed of each of the intermediate transfer belt 6 and the transfer-sheet conveying belt 8.

Figure 7:
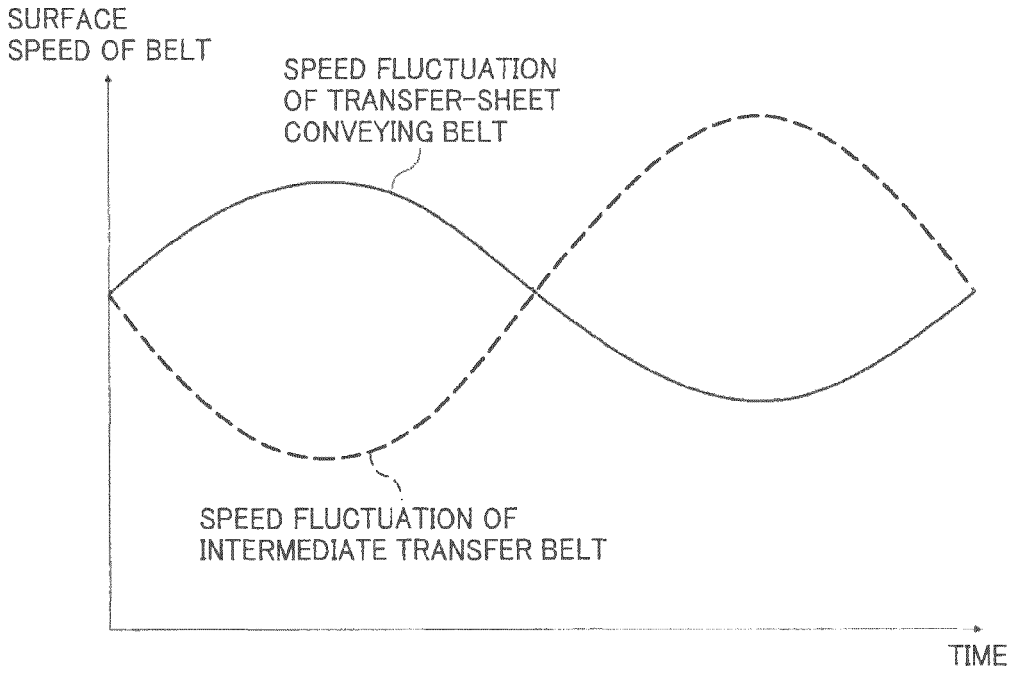
FIG. 7 is a diagram that illustrates fluctuation of the surface speed of each of an intermediate transfer belt and a transfer-sheet conveying belt.
Figure 8:
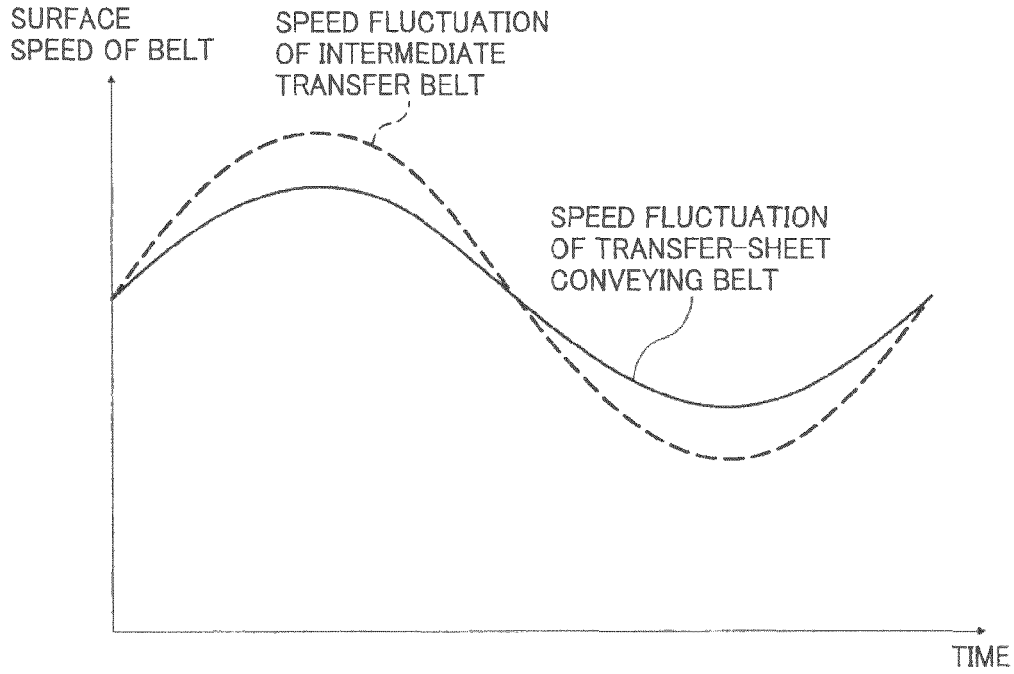
FIG. 8 is a diagram that illustrates fluctuation of the surface speed of each of the intermediate transfer belt and the transfer-sheet conveying belt after alignment control is performed.

FIG. 7 is a diagram that illustrates fluctuation of the surface speed of each of the intermediate transfer belt and the transfer-sheet conveying belt. FIG. 8 is a diagram that illustrates fluctuation of the surface speed of each of the intermediate transfer belt and the transfer-sheet conveying belt after alignment control is performed. In the example illustrated in FIG. 7, the state is such that the phase shift (difference) between the fluctuation of the surface speed of the intermediate transfer belt 6 and the fluctuation of the surface speed of the transfer-sheet conveying belt 8 is large and significant misalignment is present due to the speed fluctuation of the intermediate transfer belt 6 and the speed fluctuation of the transfer-sheet conveying belt 8. The phase shift can be reduced by delaying the time when the rotation of one of the belts is started or decreasing the rotation speed of one of the belts so that the degree of misalignment due to the speed fluctuation of the intermediate transfer belt 6 and the speed fluctuation of the transfer-sheet conveying belt 8 can be reduced.

For example, if the fluctuation of the surface speed of the intermediate transfer belt 6 and the fluctuation of the surface speed of the transfer-sheet conveying belt 8 are determined as illustrated in FIG. 7, the alignment control unit 52 outputs a command signal to the driver 307*a* via the transfer drive motor I/F 306*a* so as to rotate the transfer drive motor M1 such that the fluctuation of the surface speed of the intermediate transfer belt 6 is shifted for a half cycle with respect to the fluctuation of the surface speed of the transfer-sheet conveying belt 8. Thus, as illustrated in FIG. 8, the alignment control unit 52 can almost match the phases of the fluctuation of the surface speed of the intermediate transfer belt 6 and the fluctuation of the surface speed of the transfer-sheet conveying belt 8 and can reduce the overall degree of misalignment due to the speed fluctuation of the intermediate transfer belt 6 and the speed fluctuation of the transfer-sheet conveying belt 8. According to the present embodiment, in order to reduce the degree of misalignment, the alignment control unit 52 controls the rotation of the intermediate transfer belt 6 by using the fluctuation of the surface speed of the transfer-sheet conveying belt 8 as a reference; however, the present invention is not limited thereto. For example, the alignment control unit 52 may control the rotation of the transfer-sheet conveying belt 8 by using the fluctuation of the surface speed of the intermediate transfer belt 6 as a reference or control the rotations of both the intermediate transfer belt 6 and the transfer-sheet conveying belt 8 so as to reduce the degree of misalignment.

In order to measure the surface speed of each of the intermediate transfer belt 6 and the transfer-sheet conveying belt 8, the above-described belt surface-speed measurement pattern 50 needs to be formed on the intermediate transfer belt 6 and the transfer-sheet conveying belt 8; however, the belt surface-speed measurement pattern 50 cannot be formed while a toner image to be transferred onto the transfer sheet P is being formed on the intermediate transfer belt 6 or while a toner image is being directly transferred onto the transfer sheet P. Hence, the surface speed of each of the intermediate transfer belt 6 and the transfer-sheet conveying belt 8 is measured when printing is not occurring. For example, the alignment control unit 52 measures the surface speeds of the intermediate transfer belt 6 and the transfer-sheet conveying belt 8 when the power of the color digital MFP 100 is turned on, when the rotations of the intermediate transfer belt 6 and the transfer-sheet conveying belt 8 are started or stopped, or the like. The alignment control unit 52 then controls the rotation of at least one of the intermediate transfer belt 6 and the transfer-sheet conveying belt 8 so as to match the phases of the fluctuation of the surface speed of the intermediate transfer belt 6 and the fluctuation of the surface speed of the transfer-sheet conveying belt 8, both of which are measured at respective times.

However, if the belt is driven for a long time without performing alignment control, the phases of the fluctuation of the surface speed of the intermediate transfer belt 6 and the fluctuation of the surface speed of the transfer-sheet conveying belt 8 can be gradually shifted. Therefore, it is appropriate to measure the surface speed of each of the intermediate transfer belt 6 and the transfer-sheet conveying belt 8 at a time before and after the belt is driven.

For example, during printing, under the control of the secondary transfer control unit 55, the print control unit 51 makes the interval between the transfer sheets P conveyed by the transfer-sheet conveying belt 8 larger than an interval that allows the belt surface-speed measurement pattern 50 to be transferred onto the intermediate transfer belt 6 and the transfer-sheet conveying belt 8 and controls the secondary transfer roller 28 of the secondary transfer unit 15 so as to locate the secondary transfer roller 28 away from the intermediate transfer belt 6. The alignment control unit 52 then measures the surface speeds of the intermediate transfer belt 6 and the transfer-sheet conveying belt 8 during the interval between the transfer sheets P conveyed by the transfer-sheet conveying belt 8. If a phase shift is present between the fluctuation of the surface speed of the intermediate transfer belt 6 and the fluctuation of the surface speed of the transfer-sheet conveying belt 8, the alignment control unit 52 interrupts the printing, stops the intermediate transfer belt 6 and the transfer-sheet conveying belt 8, and then rotates the intermediate transfer belt 6 and the transfer-sheet conveying belt 8 again, thereby reducing the phase shift between the fluctuation of the surface speed of the intermediate transfer belt 6 and the fluctuation of the surface speed of the transfer-sheet conveying belt 8.

With reference to FIGS. 9 to 11, an explanation is given of an example of the process performed by the alignment control unit 52 to match the phases of the fluctuation of the surface speed of the intermediate transfer belt 6 and the fluctuation of the surface speed of the transfer-sheet conveying belt 8 by using the difference between the surface speed of the intermediate transfer belt 6 and the surface speed of the transfer-sheet conveying belt 8. FIG. 9 is a table that illustrates measurement results of the surface speeds of the intermediate transfer belt and the transfer-sheet conveying belt and the difference between the surface speeds of the belts. FIG. 10 is a table that illustrates measurement results of the surface speeds of the intermediate transfer belt and the transfer-sheet conveying belt and also illustrates the surface speed of the transfer-sheet conveying belt and the difference between the surface speeds of the belts when the rotation of the transfer-sheet conveying belt is delayed for the time according to the phase difference corresponding to one pattern. FIG. 11 is a table that illustrates measurement results of the surface speeds of the intermediate transfer belt and the transfer-sheet conveying belt and also illustrates the surface speed of the transfer-sheet conveying belt and the difference between the surface speeds of the belts when the rotation of the transfer-sheet conveying belt is delayed for the times according to the phase differences corresponding to one to seven patterns. The measurement results of the surface speed of the intermediate transfer belt 6 and the surface speed of the transfer-sheet conveying belt 8 illustrated in FIGS. 9 to 11 are examples of a case where the belt surface-speed measurement pattern 50, which is obtained by arranging eight straight-line patterns at equal intervals in the sub-scanning direction, is formed for one cycle of each of the belts 6 and 8.

As illustrated in FIG. 9, before the phases of the fluctuation of the surface speed of the intermediate transfer belt 6 and the fluctuation of the surface speed of the transfer-sheet conveying belt 8 are matched with each other, the difference between the surface speed of the intermediate transfer belt 6 and the surface speed of the transfer-sheet conveying belt 8 is largest between the second pattern and the third pattern of the belt surface-speed measurement pattern 50 and between the sixth pattern and the seventh pattern of the belt surface-speed measurement pattern 50. Further, before the phases of the fluctuation of the surface speed of the intermediate transfer belt 6 and the fluctuation of the surface speed of the transfer-sheet conveying belt 8 are matched with each other, the sum of the differences between the surface speed of the intermediate transfer belt 6 and the surface speed of the transfer-sheet conveying belt 8 is 160 msec.

If a difference occurs between the surface speed of the intermediate transfer belt 6 and the surface speed of the transfer-sheet conveying belt 8 (see FIG. 9), the alignment control unit 52 calculates the difference between the surface speeds of the belts 6 and 8 and the sum of the differences in a case where the rotation of the transfer-sheet conveying belt 8 is delayed for the times according to the phase differences corresponding to one to seven patterns of the belt surface-speed measurement pattern 50 by using the rotation of the intermediate transfer belt 6 as a reference.

For example, to calculate the difference between the surface speeds of the belts 6 and 8 and the sum of the differences in a case where the rotation of the transfer-sheet conveying belt 8 is delayed for the time according to the phase difference corresponding to one pattern of the belt surface-speed measurement pattern 50 by using the rotation of the intermediate transfer belt 6 as a reference, as illustrated in FIG. 10, the alignment control unit 52 first calculates the surface speed between the patterns in a case where the rotation of the transfer-sheet conveying belt 8 is started with a delay corresponding to one pattern of the belt surface-speed measurement pattern 50 by using the rotation of the intermediate transfer belt 6 as a reference.

Specifically, the alignment control unit 52 calculates the surface speed between the first and the second patterns of the belt surface-speed measurement pattern 50 formed on the transfer-sheet conveying belt 8 as the surface speed between the reference and the first patterns. The alignment control unit 52 calculates the surface speed between the second and the third patterns of the belt surface-speed measurement pattern 50 formed on the transfer-sheet conveying belt 8 as the surface speed between the first and the second patterns. The alignment control unit 52 calculates the surface speed between the third and the fourth patterns of the belt surface-speed measurement pattern 50 formed on the transfer-sheet conveying belt 8 as the surface speed between the second and the third patterns. The alignment control unit 52 calculates the surface speed between the fourth and the fifth patterns of the belt surface-speed measurement pattern 50 formed on the transfer-sheet conveying belt 8 as the surface speed between the third and the fourth patterns. The alignment control unit 52 calculates the surface speed between the fifth and the sixth patterns of the belt surface-speed measurement pattern 50 formed on the transfer-sheet conveying belt 8 as the surface speed between the fourth and the fifth patterns. The alignment control unit 52 calculates the surface speed between the sixth and the seventh patterns of the belt surface-speed measurement pattern 50 formed on the transfer-sheet conveying belt 8 as the surface speed between the fifth and the sixth patterns. The alignment control unit 52 calculates the surface speed between the seventh and the reference patterns of the belt surface-speed measurement pattern 50 formed on the transfer-sheet conveying belt 8 as the surface speed between the sixth and the seventh patterns. The alignment control unit 52 calculates the surface speed between the reference and the first patterns of the belt surface-speed measurement pattern 50 formed on the transfer-sheet conveying belt 8 as the surface speed between the seventh and the reference patterns.

As illustrated in FIG. 10, the alignment control unit 52 then calculates the difference between the surface speeds of the belts 6 and 8 and the sum of the differences in a case where the rotation of the transfer-sheet conveying belt 8 is started with a delay corresponding to one pattern of the belt surface-speed measurement pattern 50 by using the rotation of the intermediate transfer belt 6 as a reference.

In the same manner, as illustrated in FIG. 11, the alignment control unit 52 calculates the difference between the surface speeds of the belts 6 and 8 and the sum of the differences in a case where the rotation of the transfer-sheet conveying belt 8 is delayed for the times according to the phase differences corresponding to two to seven patterns of the belt surface-speed measurement pattern 50 by using the rotation of the intermediate transfer belt 6 as a reference.

The alignment control unit 52 then delays the start of rotation of the transfer-sheet conveying belt 8 with respect to the start of rotation of the intermediate transfer belt 6 for the time corresponding to the phase difference for which the sum of the differences between the surface speeds of the belts 6 and 8 is the smallest (the phase difference (½ cycle) corresponding to the four patterns of the belt surface-speed measurement pattern 50) among the phase differences corresponding to one to seven patterns of the belt surface-speed measurement pattern 50. Thus, the alignment control unit 52 matches the phases of the fluctuation of the surface speed of the intermediate transfer belt 6 and the fluctuation of the surface speed of the transfer-sheet conveying belt 8.

Thus, in the color digital MFP 100 according to the present embodiment, the rotation of at least one of the transfer-sheet conveying belt 8 and the intermediate transfer belt 6 is controlled so as to match the phases of the fluctuation of the surface speed of the intermediate transfer belt 6 and the fluctuation of the surface speed of the transfer-sheet conveying belt 8, whereby it is possible to keep the periodical speed fluctuations of both the intermediate transfer belt 6 and the transfer-sheet conveying belt 8 to the minimum and reduce misalignment among images in all colors.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a transfer-sheet conveying unit that is rotated to convey a transfer sheet;

a first image forming unit that directly transfers a single-color image onto the transfer sheet that is in a process of being conveyed;

an intermediate transfer unit that is rotated while an image to be transferred onto the transfer sheet that is in the process of being conveyed is transferred thereon, the intermediate transfer unit having an identical length in a circumferential direction to a length of the transfer-sheet conveying unit in a circumferential direction;

a second image forming unit that transfers, onto the intermediate transfer unit, an image in a plurality of colors except for a color of the image directly transferred by the first image forming unit;

a secondary transfer unit that transfers the image transferred onto the intermediate transfer unit onto the transfer sheet that is in the process of being conveyed;

a measuring unit that measures surface speeds of the transfer-sheet conveying unit and the intermediate transfer unit for a predetermined number of cycles; and a control unit that controls rotation of at least one of the transfer-sheet conveying unit and the intermediate transfer unit so as to match phases of fluctuation of the measured surface speed of the transfer-sheet conveying unit and fluctuation of the measured surface speed of the intermediate transfer unit.

2. The image forming apparatus according to claim 1, wherein the measuring unit measures the surface speeds of the transfer-sheet conveying unit and the intermediate transfer unit for one cycle.

3. The image forming apparatus according to claim 1, wherein the measuring unit measures the fluctuations of the surface speeds of the transfer-sheet conveying unit and the intermediate transfer unit when power of the image forming apparatus is turned on, and the control unit controls rotation of at least one of the transfer-sheet conveying unit and the intermediate transfer unit so as to match the phases of the fluctuation of the surface speed of the transfer-sheet conveying unit and the fluctuation of the surface speed of the intermediate transfer unit that are measured when the power of the image forming apparatus is turned on.

4. The image forming apparatus according to claim 1, wherein the measuring unit measures the fluctuations of the surface speeds of the transfer-sheet conveying unit and the intermediate transfer unit when rotations of the transfer-sheet conveying unit and the intermediate transfer unit are stopped, and the control unit controls rotation of at least one of the transfer-sheet conveying unit and the intermediate transfer unit so as to match the phases of the fluctuation of the surface speed of the transfer-sheet conveying unit and the fluctuation of the surface speed of the intermediate transfer unit that are measured when the rotations of the transfer-sheet conveying unit and the intermediate transfer unit are stopped.

5. The image forming apparatus according to claim 1, wherein the measuring unit measures the fluctuations of the surface speeds of the transfer-sheet conveying unit and the intermediate transfer unit when rotations of the transfer-sheet conveying unit and the intermediate transfer unit are started, and the control unit controls rotation of at least one of the transfer-sheet conveying unit and the intermediate transfer unit so as to match the phases of the fluctuation of the surface speed of the transfer-sheet conveying unit and the fluctuation of the surface speed of the intermediate transfer unit that are measured when the rotations of the transfer-sheet conveying unit and the intermediate transfer unit are started.

6. The image forming apparatus according to claim 1, wherein the measuring unit measures the fluctuations of the surface speeds of the transfer-sheet conveying unit and the intermediate transfer unit during an interval between transfer sheets conveyed by the transfer-sheet conveying unit, and if a phase shift is present between the fluctuation of the surface speed of the transfer-sheet conveying unit and the fluctuation of the surface speed of the intermediate transfer unit that are measured during the interval between the transfer sheets conveyed by the transfer-sheet conveying unit, the control unit stops the intermediate transfer unit and the transfer-sheet conveying unit and then rotates the intermediate transfer unit and the transfer-sheet conveying unit again.

7. An image forming method for an image forming apparatus that includes a transfer-sheet conveying unit that is rotated to convey a transfer sheet;

a first image forming unit that directly transfers a single-color image onto the transfer sheet that is in a process of being conveyed;

an intermediate transfer unit that is rotated while an image to be transferred onto the transfer sheet that is in the process of being conveyed is transferred thereon, the intermediate transfer unit having an identical length in a circumferential direction to a length of the transfer-sheet conveying unit in a circumferential direction;

a second image forming unit that transfers, onto the intermediate transfer unit, an image in a plurality of colors except for a color of the image directly transferred by the first image forming unit; and a secondary transfer unit that transfers the image transferred onto the intermediate transfer unit onto the transfer sheet that is in the process of being conveyed, the image forming method comprising:

measuring, by a measuring unit, surface speeds of the transfer-sheet conveying unit and the intermediate transfer unit for a predetermined number of cycles; and controlling, by a control unit, rotation of at least one of the transfer-sheet conveying unit and the intermediate transfer unit so as to match phases of fluctuation of the measured surface speed of the transfer-sheet conveying unit and fluctuation of the measured surface speed of the intermediate transfer unit.

8. A computer program product comprising a non-transitory computer usable medium having computer readable program codes embodied in the medium that when executed causes a computer to execute an image forming method for an image forming apparatus that includes a transfer-sheet conveying unit that is rotated to convey a transfer sheet;

a first image forming unit that directly transfers a single-color image onto the transfer sheet that is in a process of being conveyed;

an intermediate transfer unit that is rotated while an image to be transferred onto the transfer sheet that is in the process of being conveyed is transferred thereon, the intermediate transfer unit having an identical length in a circumferential direction to a length of the transfer-sheet conveying unit in a circumferential direction;

a second image forming unit that transfers, onto the intermediate transfer unit, an image in a plurality of colors except for a color of the image directly transferred by the first image forming unit; and a secondary transfer unit that transfers the image transferred onto the intermediate transfer unit onto the transfer sheet that is in the process of being conveyed;

the image forming method including:

measuring, by a measuring unit, surface speeds of the transfer-sheet conveying unit and the intermediate transfer unit for a predetermined number of cycles; and controlling, by a control unit, rotation of at least one of the transfer-sheet conveying unit and the intermediate transfer unit so as to match phases of fluctuation of the measured surface speed of the transfer-sheet conveying unit and fluctuation of the measured surface speed of the intermediate transfer unit.

* * * * *